United States Patent [19]

Weyer

[11] Patent Number: 5,054,372

[45] Date of Patent: Oct. 8, 1991

[54] ADJUSTABLE SHAFT ACTUATOR

[76] Inventor: Paul P. Weyer, P.O. Box 398, Enumclaw, Wash. 98022

[21] Appl. No.: 654,768

[22] Filed: Feb. 13, 1991

[51] Int. Cl.[5] ..... F01B 31/14; F15B 15/24

[52] U.S. Cl. ..... 92/13.5; 92/13.6; 92/32; 92/33; 74/89

[58] Field of Search ..... 92/13, 13.5, 13.6, 31, 92/32, 33; 74/409, 89

[56] References Cited

U.S. PATENT DOCUMENTS

| | | | |
|---|---|---|---|
| 4,373,334 | 2/1983 | Carlander | 92/33 |
| 4,545,289 | 10/1985 | Weyer | 92/13.6 |
| 4,683,767 | 8/1987 | Weyer | 74/409 |
| 4,858,486 | 8/1989 | Weyer | 74/409 |
| 4,949,936 | 8/1990 | Messina | 92/13.6 |

*Primary Examiner*—Edward K. Look
*Assistant Examiner*—Thomas Denion
*Attorney, Agent, or Firm*—Seed and Berry

[57] ABSTRACT

A fluid-powered rotary actuator having a body with first and second ends, and a shaft extending generally coaxially within the body. The shaft is supported for rotational movement relative to the body by bearing races formed on the shaft first and second end portions and corresponding bearing races formed on a pair of first and second end caps. First and second stop rings are disposed within the body, each adjacent to a corresponding end cap, with the shaft extending therethrough. The stop rings are each freely and longitudinally movable on the shaft within a limited axial range. The stop rings are positioned using set screws which extend through the end caps and engage the stop rings at selected longitudinal positions within their limited axial ranges. When the first and second stop rings are positioned, they engage and limit axial travel of the piston sleeve toward the end caps, and hence provide preselected and adjustable and rotational limits for the rotational travel of the shaft.

7 Claims, 2 Drawing Sheets

ADJUSTABLE SHAFT ACTUATOR

TECHNICAL FIELD

The present invention relates generally to actuators, and more particularly, to fluid-powered rotary actuators in which axial movement of a piston results in relative rotational movement between a body and an output shaft.

BACKGROUND OF THE INVENTION

Rotary helical splined actuators have been employed in the past to achieve the advantage of high-torque output from a simple linear piston-and-cylinder drive arrangement. The actuator typically uses a cylindrical body with an elongated rotary output shaft extending coaxially within the body, with an end portion of the shaft providing the drive output. An elongated annular piston sleeve has a sleeve portion splined to cooperate with corresponding splines on the body interior and the output shaft exterior. The piston sleeve is reciprocally mounted within the body and has a head for the application of fluid pressure to one or the other opposing sides thereof to produce axial movement of the piston sleeve.

As the piston sleeve linearly reciprocates in an axial direction within the body, the outer splines of the sleeve portion engage the splines of the body to cause rotation of the sleeve portion. The resulting linear and rotational movement of the sleeve portion is transmitted through the inner splines of the sleeve portion to the splines of the shaft to cause the shaft to rotate. Bearings are typically supplied to rotatably support one or both ends of the shaft relative to the body.

A shortcoming of such rotary helical actuators, however, is that when the rotary motion on the output shaft is used to rotate another device or shaft, such as a valve stem in a fluid-control valve, there is provided no means for limiting the amount of rotation of the shaft within precise preselected and adjustable limits. Limiting the rotation is critical to avoid the actuator overdriving the device to which connected beyond its normal range of positions, and in some situations, from turning the device sufficiently to cause it damage.

It will therefore be appreciated that there has long a significant need for a fluid-powered rotary actuator with precise preselected and adjustable end rotational limits on the rotational travel of the output shaft which are adjustable from the ends of the actuator. The actuator should provide positive and accurate control of the rotational travel of the shaft, and be operable with the normal forces which occur with fluid-powered rotary actuators. The present invention fulfills these needs and further provides other related advantages.

DISCLOSURE OF THE INVENTION

The present invention resides in a fluid-powered rotary actuator having a body with a longitudinal axis, and first and second ends. The actuator further has a drive member extending longitudinally and generally coaxially within the body, and is supported for rotational movement relative to the body. Either the drive member or the body is adapted for coupling to an external device to provide rotational drive thereto.

A piston sleeve is mounted for reciprocal longitudinal movement within the body. The piston sleeve has a piston portion for the selective application of pressurized fluid thereto to produce selective longitudinal movement of the piston sleeve toward the body first and second ends. The piston sleeve also has a sleeve portion engaging the body and the drive member to translate longitudinal movement of the piston toward the body first end into rotational movement between the drive member and the body in a first rotational direction, and longitudinal movement of the piston toward the body second end into rotational movement between the drive member and the body in a second rotational direction.

First and second annular stop members are provided, each having a central aperture. The first annular stop member is positioned within the body toward the body first end, between the body first end and the piston sleeve, with the drive member extending through the first annular stop member aperture. Similarly, the second annular stop member is positioned within the body toward the body second end, between the body second end and the piston sleeve, with the drive member extending through the second annular stop member aperture.

The first annular stop member is longitudinally, adjustably movable within the body and is positioned to engage and limit the travel of the piston sleeve toward the body first end to provide an end limit to rotational movement between the drive member and the body in the first rotational direction. The second annular stop member is longitudinally, adjustably movable within the body and is positioned to engage and limit the travel of the piston sleeve toward the body second end to provide an end limit to rotational movement between the drive member and the body in the second rotational direction.

A first adjustment member is provided toward the body first end and is adjustable to engage the first annular stop member at selected longitudinal positions of the first annular stop member within the body. A second adjustment member is provided toward the body second end and is adjustable to engage the second annular stop member at selected longitudinal positions of the second annular stop member within the body.

In the preferred embodiment of the invention, the fluid-powered rotary actuator has first and second end caps, each having a central aperture with the drive member extending therewithin. The first end cap is positioned within the body toward the body first end and has an interior ball race confronting and corresponding to a first end ball race formed on the drive member to define a first set of races extending circumferentially about the drive member and rotatably supporting the drive member. The second end cap is positioned within the body toward the second body end and has an interior ball race confronting and corresponding to a second end ball race formed on the drive member to define a second set of races extending circumferentially about the drive member and rotatably supporting the drive member. One or more balls are seated in each of the first and second sets of races.

In the preferred embodiment, the first and second annular stop members are first and second stop rings. Further, the first and second adjustment members are supported by the first and second end caps, respectively. The first and second adjustment members project from the first and second end caps toward the corresponding first and second stop rings, and are selectively extendable. In the preferred embodiment, the first and second adjustment members each include a plurality of axially inward extendable set screws.

The drive member further includes a first stop portion sized larger than the first stop ring central aperture to limit axial movement of the first stop ring on the drive member toward the body second end. The drive member also has a second stop portion sized larger than the second stop ring central aperture to limit axial movement of the second stop ring on the drive toward the body first end.

Other features and advantages of the invention will become apparent from the following detailed description, taken in conjunction with the accompanying drawings.

BEST MODE FOR CARRYING OUT THE INVENTION

Figure 1:
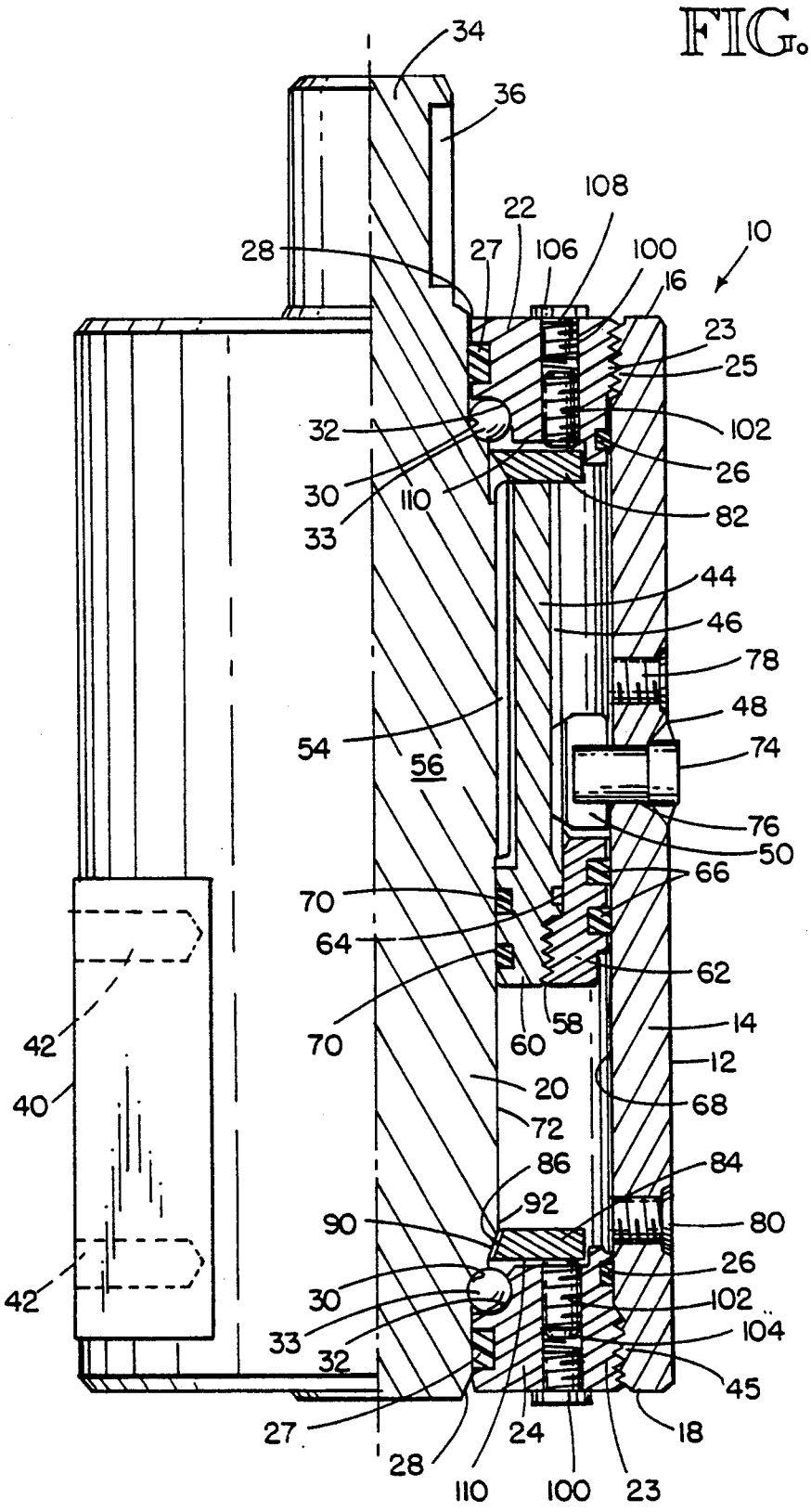
FIG. 1 is a side elevational, sectional view of a fluid-powered rotary splined actuator embodying the present invention.

As shown in the drawings for purposes of illustration, the present invention is embodied in a fluid-powered rotary actuator 10. The actuator 10 includes an elongated housing or body 12 having a cylindrical sidewall 14 and first and second ends 16 and 18, respectively. A rotary output shaft 20 is coaxially positioned within the body 12 and supported for rotation relative to the body, as well as described in more detail below.

A first end cap 22 is threadably attached to the body 12 at the body first end 16 and a second end cap 24 is threadably attached to the body at the body second end 18. Each of the first and second caps 22 and 24 has a threaded exterior perimeter portion 23 threadably attached to a correspondingly threaded interior portion 25 of the body sidewall 14. A seal 26 is disposed between each of the first and second caps 22 and 24 and the body sidewall 14 to provide a fluid-tight seals therebetween. A seal 27 is disposed between each of the first and second caps 22 and 24 and the shaft 20 to provide fluid-tight seals therebetween.

The shaft 20 extends the full length of the body 12 and extends through a central aperture 28 in each of the first and second caps 22 and 24. The shaft 20 has a pair of circumferential ball races 30 formed thereon, each being adjacent to one of the first and second caps 22 and 24. The first and second caps 22 and 24 each have an inward opening ball race 32 extending about the aperture 28 therein, which confronts a corresponding one of the ball races 30 on the shaft 20 to form two sets of races. A plurality of ball bearings 33 are seated in each of the two sets of races and rotatably support the shaft 20 relative to the body 12.

The shaft 20 and the first and second caps 22 and 24 are hardened to withstand the wear of the ball bearings 33 on the ball races 30 and 32. This permits use of a loose ball bearing arrangement and nylon spacers (not shown) between the ball bearings 33. The nylon spacers reduce the drag that results if adjacent ball bearings contact each other. The first and second caps 22 and 24 are axially adjustable by selective rotation thereof to preload the ball bearings 33 prior to commencing fluid-powered operation of the actuator 10.

The shaft 20 extends outward of the body 12 through the aperture 28 in the first cap 22 and has a drive end portion 34 extending beyond the first cap for coupling to an external device (not shown). The drive end portion 34 has a slot 36 to receive a key (not shown). It is to be understood that the invention may be practiced with the shaft 20 rotatably driving an external device, or with the shaft being held stationary and the rotational drive being provided by rotation of the body 12.

The body 12 has a pair of outward projecting attachment brackets 40 located toward the body second end 18. Each bracket 40 has a pair threaded holes 42 for attachment of the body 12 to a support frame (not shown).

The actuator 10 has a conventional linear-to-rotary transmission means which includes an annular piston sleeve 44 which is reciprocally mounted within the body 12 coaxially about the shaft 20. The piston sleeve 44 has outer helical splines 46 over a portion of its length which mesh with inner helical splines 48 of a ring gear 50. The piston sleeve 44 is also provided with inner helical splines 52 which mesh with outer helical splines 54 provided on a splined intermediate portion 56 of the shaft 20. It should understood that while helical splines are shown in the drawings and described herein, the principle of the invention is equally applicable to any form of linear-to-rotary motion conversion means, such as balls or rollers.

In the illustrated embodiment of the invention, the piston sleeve 44 has an annular two-piece piston 58 positioned at an end of the piston sleeve toward the body second end 18. The piston 58 is formed of a head portion 60 and a piston ring 62 which extends about the head portion and is threadably attached thereto. A seal 64 disposed between the head portion 60 and the piston ring 62 provides a fluid-tight seal therebetween. The piston 58 is slidably maintained within the body 12 for reciprocal movement, and undergoes longitudinal and rotational movement relative to a the body 12 during fluid-powered operation of the actuator 10, as will be described in more detail below.

A pair of seals 66 are disposed between the piston ring 62 of and a smooth interior wall surface 68 of the body 12 to provide a fluid-tight seal therebetween. A pair of seals 70 are disposed between the head portion 60 and a smooth exterior wall surface 72 of the shaft 20 to provide a fluid-tight seal therebetween.

The ring gear 50 is joined to the body 12 by a plurality of pins 74 which are uniformly positioned about the body sidewall 14 and extend through a plurality of ring gear fastening holes 76 in the sidewall. The pins 64 are welded to the body sidewall 14.

As will be readily understood, reciprocation of the piston 58 within the body 12 occurs when hydraulic oil, air or any other suitable fluid under pressure selectively enters through a first port 78 to one side of the piston toward the body first end 16 or through a second port 80 to the other side of the piston toward the body second end 18. As the piston 58, and the piston sleeve 44 of which the piston is a part, linearly reciprocates in an axial direction within the body 12 as a result of selective application of pressurized fluid to the piston, the outer helical splines 46 of the piston sleeve engage or mesh with the inner helical splines 48 of the ring gear 50 to cause rotation of the piston sleeve. The linear and rotational movement of the piston sleeve 44 is transmitted through the inner helical splines 52 of the piston sleeve to the outer helical splines 54 of the shaft intermediate portion 56 to cause the shaft 20 to rotate relative to the body 12. The axial movement of the shaft 20 is restricted by the ball bearings 33, thereby converting all movement of the piston sleeve 44 into rotational movement of the shaft. Depending on the slope and direction of turn of the various helical splines, there may be provided a multiplication of the rotary output of the shaft 20.

The application of fluid pressure to the port 78 produces axial movement of the piston sleeve 44 toward the body second end 18. The application of fluid pressure to the port 80 produces axial movement of the piston sleeve 44 toward the body first end 16. The actuator 10 provides relative rotational movement between the body 12 and the shaft 20 through the conversion of this linear movement of the piston sleeve 44 into rotational movement of the shaft, in a manner well known in the art.

In accordance with the present invention, the actuator 10 includes first and second stop rings 82 and 84, respectively. Each of the first and second stop rings 82 and 84 has a central aperture 86. The first stop ring 82 is coaxially positioned within the body 12 at the body first end 16. The first stop ring 82 has its central aperture 86 sized large enough to loosely receive a first end portion 88 of shaft 20 therein, but small enough that the first stop ring will engage the outer helical splines 54 of the shaft intermediate portion 56 if it moves a sufficient distance axially toward the body second end 18. As such, the first stop ring 82 has its axial movement on the shaft 20 limited to the distance between the first cap 22 and the end of the outer helical splines 54 toward the body first end 16.

Similarly, the second stop ring 84 is coaxially positioned within the body 12 at the body second end 18. The second stop ring 84 has its central aperture 86 sized large enough to loosely receive a second end portion 90 of the shaft 20 therein, but small enough that the second stop ring will engage an enlarged diameter portion 92 of the shaft 20 toward the shaft intermediate portion 56 if it moves a sufficient distance axially toward the body first end 16. As such, the second stop ring 84 has its axial movement on the shaft 20 limited to the distance between the second cap 24 and the shaft enlarged diameter portion 92.

Figure 2:
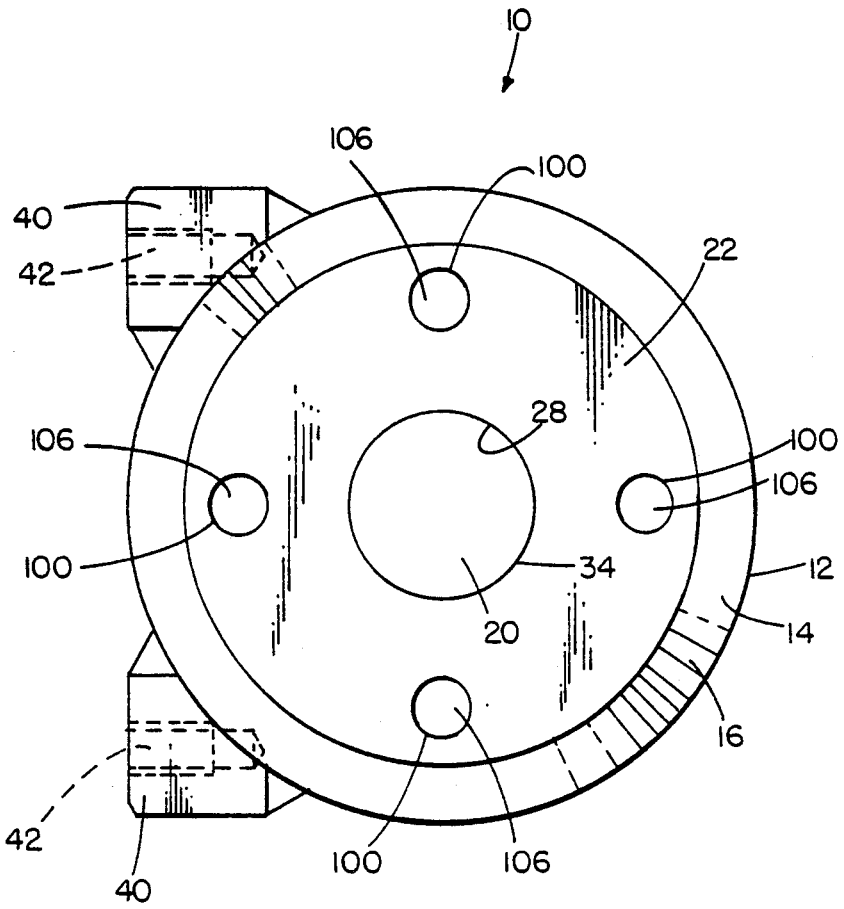
FIG. 2 is an end elevational view of the first end of the actuator of FIG. 1.

The first and second caps 22 and 24 each have four uniformly circumferentially spaced-apart holes 100 therethrough. The distribution of the holes is best shown in FIG. 2. Each of the holes 100 is threaded to threadably receive a correspondingly threaded set screw 102 therein. The set screw 102 has an internal hex head portion 104 for adjustable rotation of the set screw 102 by the user from the exterior of the actuator 10 with a compatible tool (not shown). After the set screw 102 has been adjusted, the hole 100 is closed with a threaded plug 106 which carries an O-ring seal 108 to prevent fluid leakage from the body 12.

As will be described in detail below, the set screws 102 are provided for the user of the actuator 10 to adjustably position the first and second stop rings 82 and 84 to limit axial travel of the piston sleeve 44 toward the body first and second ends 16 and 18, respectively. By so setting the end limits to the linear movement of the piston sleeve 44 within the body 12, the user is also setting the rotational end limits for the rotational travel of the shaft 20. Use of the set screws 102 and the first and second stop rings 82 and 84 provides means for precisely and adjustably preselecting the end limits of rotational travel of the shaft 20 from the first and second body ends 16 and 18 of the actuator 10 without disassembly of the actuator's linear-to-rotary transmission members. A positive, accurate, and easy adjustment means is provided which has the structural strength to withstand the extreme forces exerted by the piston sleeve 44 during fluid-powered operation of the actuator 10.

To accomplish the adjustment, each of the set screws 102 is adjustably rotatable to inwardly extend the set screw out of its hole 100 and beyond an inward face 110 of the first or second cap 22 or 24 to engage a corresponding one of the first or second stop ring 82 or 84. As previously described, the first and second stop rings 82 and 84 are loosely retained on the shaft first and second end portions 88 and 90 and allowed to freely move axially within the body 12 on the shaft 20 within at least a limited range. By adjustably extending the set screws 102 of the first and second caps 22 and 24 inwardly a desired amount, the extent of axial movement of the first and second stop rings 82 and 84 toward the first and second caps 22 and 24, respectively, and hence the body first and second ends 16 and 18, when engaged by the piston sleeve 44 can be precisely set.

It is noted that in the presently preferred embodiment of the invention, the axial movement of the first and second stop rings 82 and 84 in the opposite directions is not restrained by the set screws 102, but only by the size of the first ring central aperture 86 not being large enough to allow the first ring 82 to move axially inward past the outer helical splines 54 and the size of the second ring central aperture 86 not being large enough to allow the second ring 84 to move axially inward past the shaft enlarged diameter portion 92. This results in the first and second stop rings 82 and 84 floating somewhat freely along the shaft 20 as the piston sleeve 44 reciprocates within the body 12, unless the piston sleeve has moved into engagement with the stop ring and pushed it into the corresponding set screws, thus limiting further movement of the stop ring and the piston sleeve in that axial direction. When the stop rings 82 and 84 are positioned to engage and limit travel of the piston sleeve 44 within the body 12 toward the body first and second ends 16 and 18 as desired using the set screws 102, the end limits of rotational movement of the shaft 20 relative to the body in both the clockwise and counterclockwise rotational directions are also precisely set and the end rotation of the shaft is confined between precise preselected and adjustable end rotational limits.

In the illustrated embodiment of the invention, the actuator 10 produces approximately 180° of shaft rotation, and the first and second stop rings 82 and 84 are axially adjustable over a sufficient distance using the set screws 102 that the rotational output of the shaft 20 can be adjusted by plus or minus 10° at each end of the shaft's stroke. The illustrated actuator 10 is designed to produce an output torque of 9,000 inch-pounds using a pressurized fluid supply of 3,000 PSI.

For purposes of illustration, a method of equally adjusting the set screws 102 in the first cap 22 to adjustably position the first stop ring 82 to set the end limit of rotational travel of the shaft 20 in one rotational direction will be described. The same procedure is used to adjust the position of the second stop ring 84 to set the end limit of rotational travel of the shaft 20 in the opposite rotational direction. First, all three set screws 102 retained in the holes 100 of the first cap 22 are rotated using a hex head tool to withdraw the set screws from the final position desired for the first stop ring 82 which corresponds to the desired end limit of rotational travel for the shaft 20. A low-pressure fluid such as compressed air from the standard machine shop air supply is applied to the port 80 to drive the piston sleeve 44 against the first stop ring 82. An initial one of the set screws 102 retained in the first cap 22 is then rotated to extend the screw to engage the first stop ring and move the first stop ring axially toward the second cap 24, and hence the second body end 18. The movement of the first stop ring 82 using this one set screw will move the piston sleeve 44 against the force of the compressed air in the axial direction toward the second cap 22. This results in rotation of the shaft 20 through the interaction of the piston sleeve 44 with the ring gear 50 and the shaft outer helical splines 54.

Inward extension of the initial set screw 102 is continued until the shaft 20 is rotated to the desired end limit of rotational travel for the shaft (i.e., the shaft angle desired when the piston sleeve 44 is driven as far as it can during fluid-powered operation toward the first cap 22). While maintaining the low-pressure compressed air on the piston sleeve 44, the other three set screws 102 retained by the first cap 22 are rotated to extend the set screws inward until they also engage the first stop ring 82. When all of the set screws 102 retained by the first cap 22 are so adjusted, the four set screws will be equally adjusted so that when the piston sleeve 44 engages the first stop ring 82 during fluid-powered operation of the actuator 10, the force applied by the piston sleeve to the first stop ring will be distributed equally to the four set screws. The set screws 102 are designed with sufficient strength to withstand the force exerted by the piston sleeve 44 during normal fluid-powered operation.

Once the set screws 102 retained by the first cap 22 are adjusted as desired, the sealing plugs 104 are installed into the holes 100. As mentioned above, the set screws 102 retained in the holes 100 of the second cap 24 can be similarly adjusted to set the end limit of rotational travel of the shaft 20 in the opposite rotational direction in the same manner just described.

It is noted that to permit the assembly of the first and second stop rings 82 and 84 on the shaft 20, and allow their uninhibited adjustment using the set screws 102 without requiring disassembly of the actuator lo, and also to allow room for the sealing plugs 106, the actuator uses a bearing arrangement to support the shaft 20 which has the two sets of races formed by the ball races 30 and 32 positioned substantially radially inward from the radial position of the set screws 102 This is accomplished by forming the ball races 30 on a reduced diameter portion of the shaft having a lesser diameter than the first and second end portions 88 and 89 of the shaft 20, whereat the first and second stop rings 82 and 84 are positioned. The ball races 32 on the first and second caps 22 and 24 are correspondingly formed on a radially inward face of the caps. This provides a small bearing envelope which frees up room for the set screws 102 and the sealing plugs 106.

It will be appreciated that, although a specific embodiment of the invention has been described herein for purposes of illustration, various modifications may be made without departing from the spirit and scope of the invention. Accordingly, the invention is not limited except as by the appended claims.

I claim:

1. A fluid-powered rotary actuator, comprising:

a generally cylindrical body having a longitudinal axis, and first and second ends;

a drive member extending longitudinally and generally co-axially within said body, said drive member having first and second end portions with said member first end portion toward said body first end and said member second end portion toward said body second end, said member first end portion having an exterior first ball race and said member second end portion having an exterior second end ball race, said drive member or said body being adapted for coupling to an external device to provide rotational drive thereto;

a first end cap having a central aperture and being positioned within said body toward said body first end with said member first end portion extending into said first end cap aperture, said first end cap having an interior ball race confronting and corresponding to said member first end ball race to form a first set of races at a first radial position adjacent to said drive member and extending circumferentially about said drive member, said first set of races rotatably supporting said member first end portion for rotational movement of said drive member relative to said body;

a second end cap having a central aperture and being positioned within said body toward said body second end with said member second end portion extending into said second insert aperture, said second end cap having an interior ball race confronting and corresponding to said member second end ball race to form a second set of races at a second radial position adjacent to said drive member and extending circumferentially about said drive member, said second set of races rotatably supporting said member second end portion for rotational movement of said drive member relative to said body;

one or more balls seated in each of said first and second sets of races;

a piston sleeve mounted for reciprocal longitudinal movement within said body, said piston sleeve having a piston, portion for the selective application of pressurized fluid thereto to produce selective .longitudinal movement of said piston sleeve toward said body first and second ends, and a sleeve portion engaging said body and said drive member to translate longitudinal movement of said piston toward said body first end into rotational movement between said drive member and said body in a first rotational direction, and longitudinal movement of said piston toward said body second end into rotational movement between said drive member and said body in a second rotational direction;

a first stop ring having a central aperture and being positioned within said body adjacent to said first end cap, between said first end cap and said piston sleeve, with said drive member extending through said first stop ring aperture, said first stop ring being free longitudinally movable within said body on said drive member within at least a first limited axial range and being positionable to engage and limit travel of said piston sleeve toward said body first end to provide an end limit to rotational movement between said drive member and said body in said first rotational direction, said first stop ring projecting radially outward toward said body sidewall to a third radial position beyond said first radial position of said first set of races;

a second stop ring having a central aperture and being positioned within said body adjacent to said second end cap, between said second end cap and said piston sleeve, with said drive member extending through said, second stop ring aperture, said second stop ring being free longitudinally movable within said body on said drive member within at least a second limited axial range and being positionable to engage and limit travel of said piston sleeve toward said body second end to provide an end limit to rotational movement between said drive member and said body in said second rotational direction, said second stop ring projecting radially outward toward said body sidewall to a fourth radial position beyond said second radial position of said second set of races;

a first adjustment member supported by said first end cap radially outward of said first radial position of said first set of races and radially inward of said third radial position to which said first stop ring projects, and adjustable to engage said first stop ring at selected longitudinal positions of said first stop ring within said first limited axial range at which said first stop ring will engage and limit axial travel of said piston sleeve toward said first end cap; and a second adjustment member supported by said second end cap radially outward of said second radial position of said second set of races and radially inward of said fourth radial position to which said second stop ring projects and adjustable to engage said second stop ring at selected longitudinal positions of said second stop ring within said second limited axial range at which said second stop ring will engage and limit axial travel of said piston sleeve toward said second end cap.

2. The fluid-powered rotary actuator of claim 1 wherein said first adjustment member projects axially inward and is selectively extendable to engage said first stop ring at desired positions within said first limited axial range, and said second adjustment member projects axially inward and is selectively extendable to engage said second stop ring at desired positions within said second limited axial range.

3. The fluid-powered rotary actuator of claim 2 adjustable using a tool, wherein said first and second end caps each include a plurality of circumferentially spaced-apart openings extending fully therethrough, each said opening having at least a threaded portion, and wherein said first and second adjustment members include a plurality of axially inward extendable set screws threadably received in said threaded portions of said openings, said set screws having a head portion for engagement with the tool and being selectable adjustable by a user through said openings from exterior of said body using the tool.

4. The fluid-powered rotary actuator of claim 1 wherein said drive member includes a first stop portion sized larger than said first stop ring central aperture to limit axial movement of said first stop ring on said drive member toward said body second end, and a second stop portion sized larger than said second stop ring central aperture to limit axial movement of said second stop ring on said drive member toward said body first end.

5. A fluid-powered rotary actuator, comprising:

a generally cylindrical body having a longitudinal axis, and first and second ends;

a drive member extending longitudinally and generally co-axially within said body, said drive member having first and second end portions with said member first end portion toward said body first end and said member second end portion toward said body second end, said member first end portion having an exterior first ball race and said member second end portion having an exterior second end ball race, said drive member or said body being adapted for coupling to an external device to provide rotational drive thereto;

a first end cap having a central aperture and being positioned within said body toward said body first end with said member first end portion extending into said first end cap aperture, said first end cap having an interior ball race confronting and corresponding to said member first end ball race to form a first set of races extending circumferentially about said drive member and rotatably supporting said member first end portion for rotational movement of said drive member relative to said body;

a second end cap having a central aperture and being positioned within said body toward said body second end with said member second end portion extending into said second insert aperture, said second end cap having an interior ball race confronting and corresponding to said member second end ball race to form a second set of races extending circumferentially about said drive member and rotatably supporting said member second end portion for rotational movement of said drive member relative to said body;

one or more balls seated in each of said first and second sets of races;

a piston sleeve mounted for reciprocal longitudinal movement within said body, said piston sleeve having a piston portion for the selective application of pressurized fluid thereto to produce selective longitudinal movement of said piston sleeve toward said body first and second ends, and a sleeve portion engaging said body and said drive member to translate longitudinal movement of said piston toward said body first end into rotational movement between said drive member and said body in a first rotational direction, and longitudinal movement of said piston toward said body second end into rotational movement between said drive and said body in a second rotational direction;

a first stop ring having a central aperture and being positioned within said body adjacent to said first end cap, between said first end cap and said piston sleeve, with said drive member extending through said first stop ring aperture, said first stop ring being longitudinally, adjustably movable within said body and being positioned to engage and limit travel of said piston sleeve toward said body first end to provide an end limit to rotational movement between said drive member and said body in said first rotational direction;

a second stop ring having a central aperture and being positioned within said body adjacent to said second end cap, between said second end cap and said piston sleeve, with said drive member extending through said second stop ring aperture, said second stop ring being longitudinally, adjustably movable within said body and being positioned to engage and limit travel of said piston sleeve toward said body second end to provide an end limit to rotational movement between said drive member and said body in said second rotational direction;

a first member supported by said first end cap and adjustable to engage said first stop ring at selected longitudinal positions of said first stop ring within said body at which said first stop ring will engage and limit axial travel of said piston sleeve toward said first end cap; and a second member supported by said second end cap and adjustable to engage said second stop ring at selected longitudinal positions of said second stop ring within said body at which said second stop ring will engage and limit axial travel of said piston sleeve toward said second end cap.

6. The fluid-powered rotary actuator of claim 5 wherein said first member projects from said first end cap inward toward said first stop ring and is selectively extendable to engage said first stop ring at desired positions within at least a limited range of axial positions for said first stop ring, and said second member projects from said second end cap inward toward said second stop ring and is selectively extendable to engage said second stop ring at desired positions within at least a limited range of axial positions for said second stop ring.

7. A fluid-powered rotary actuator, comprising:

a body having a longitudinal axis, and first and second ends;

a drive member extending longitudinally and generally co-axially within said body, said drive member being supported for rotational movement relative to said body, said drive member or said body being adapted for coupling to an external device to provide rotational drive thereto;

a piston sleeve mounted for reciprocal longitudinal movement within said body, said piston sleeve having a piston portion for the selective application of pressurized fluid thereto to produce selective longitudinal movement of said piston sleeve toward said body first and second ends, and a sleeve portion engaging said body and said drive member to translate longitudinal movement of said piston toward said body first end into rotational movement between said drive member and said body in a first rotational direction, and longitudinal movement of said piston toward said body second end into rotational movement between said drive member and said body in a second rotational direction;

a first annular stop member having a central aperture and being positioned within said body toward said body first end, between said body first end and said piston sleeve, with said drive member extending through said first annular stop member aperture, said first annular stop member being free longitudinally, adjustably movable within said body on said drive member within at least a first limited axial range and being positionable to engage and limit travel of said piston sleeve toward said body first end to provide an end limit to rotational movement between said drive member and said body in said first rotational direction;

a second annular stop member having a central aperture and being positioned within said body toward said body second end, between said body second end and said piston sleeve, with said drive member extending through said second annular stop member aperture, said second annular stop member being free longitudinally, adjustably movable within said body on said drive member within at least a second limited axial range and being positionable to engage and limit travel of said piston sleeve toward said body second end to provide an end limit to rotational movement between said drive member and said body in said second rotational direction;

a first adjustment member toward said body first end and adjustable to engage said first annular stop member at selected longitudinal positions of said first annular stop member within said first axial range at which said first annular stop member will engage and limit axial travel of said piston sleeve toward said body first end; and a second adjustment member toward said body second end and adjustable to engage said second annular stop member at selected longitudinal positions of said second annular stop member within said second axial range at which said second annular stop member will engage and limit axial travel of said piston sleeve toward said second body end.

* * * * *